US006063007A

United States Patent [19]

Sithole

[11] Patent Number: 6,063,007

[45] Date of Patent: May 16, 2000

[54] MODULAR AEROBIC-EXERCISE STEPPER

[76] Inventor: Deborah Sithole, 63 I.U. Willets Rd., Albertson, N.Y. 11507

[21] Appl. No.: 09/081,876

[22] Filed: May 20, 1998

Related U.S. Application Data

[63] Continuation-in-part of application No. 08/651,917, May 21, 1996, Pat. No. 5,772,559.

[51] Int. Cl.[7] ..... A63B 22/00

[52] U.S. Cl. ..... 482/52; 482/51; 297/440.14

[58] Field of Search ..... 297/423.39, 423.41, 297/423.4, 440.14, DIG. 6; 482/23, 35, 24, 51, 52; 52/604, 590.1, 591.3, DIG. 13, 183, 6, 7

[56] References Cited

U.S. PATENT DOCUMENTS

| | | | |
|---|---|---|---|
| 615,832 | 12/1898 | Fields | 52/590.2 |
| 3,035,671 | 5/1962 | Sicherman | 482/52 |
| 3,251,076 | 5/1966 | Burke | 482/23 |
| 3,773,329 | 11/1973 | Sector | 297/440.14 |
| 5,162,028 | 11/1992 | Wilkinson | 482/52 |
| 5,212,842 | 5/1993 | Glyclon | 482/23 |
| 5,409,325 | 4/1995 | Wu | 52/604 |
| 5,474,509 | 12/1995 | Hodgdon | 482/51 |
| 5,509,720 | 4/1996 | Croom | 297/440.14 |
| 5,540,638 | 7/1996 | Wilkinson | 482/52 |

FOREIGN PATENT DOCUMENTS

| | | | |
|---|---|---|---|
| 2420208 | 11/1975 | Germany | 247/455 |

*Primary Examiner*—Jerome Donnelly
*Attorney, Agent, or Firm*—Thomas L. Bohan & Associates; Thomas L. Bohan

[57] ABSTRACT

A stepper for use during aerobic stepping exercises. The invention has modular platforms that allow for one or more platforms to be horizontally attached to a central platform. Side platforms can be attached to the center platform forming steps in every direction surrounding the center so that the user may step from one platform to another in any direction. Non-slip rubber material on opposing surfaces of each platform provide stability during use. In the Preferred Embodiment, the modular platforms are hollow creating a light-weight but high-strength design for ease of transport. The means of attachment of the side platforms to the center platform can be varied from the use of nuts and bolts, through hook-and-loop techniques, to groove-and-protuberance techniques, the latter allowing the side platforms to be snapped onto the center platform for the purpose of repetitive stepping exercise in a park, a gymnasium or the like and then unsnapped for easy transport home.

4 Claims, 6 Drawing Sheets

MODULAR AEROBIC-EXERCISE STEPPER

CROSS REFERENCE TO RELATED PATENT APPLICATION

This application is a continuation-in-part (CIP) of the Deborah Sithole U.S. patent application Ser. No. 08/651,917, filed on May 21, 1996, now U.S. Pat. No. 5,772,559, entitled MODULAR AEORBIC-EXERCISE STEPPER and the contents of that related application are incorporated herein by reference.

BACKGROUND OF THE INVENTION

1. Field of the Invention

The present invention relates to exercise devices. More specifically, this invention relates to modular exercise devices for elevated stepping used during aerobic exercising.

2. Background of the Invention

Adjustable stepping platforms are known in the exercise device art Such stepping platforms are utilized in the performance of various aerobic exercise routines. These exercise routines typically involve stepping, jumping, or hopping movements. Commonly termed "aerobics," these exercise routines are performed by an individual through elevated leg movements The exercise routines involve basic movements initially and tend to become more complex according to the level of exercise instruction. As the complexity of the movements increases, the versatility of the adjustable stepping platforms used is pushed to the limits. Individuals may need to re-adjust or re-configure the adjustable stepping platform. Protracted periods of stepping-platform adjustment occurs when the mechanics of adjusting the stepping platform is involved and complex. The interruption necessitated by stepper platform readjustment and resultant delay in exercising adversely affects the healthful aerobic effect of the exercise routine.

Several prior-art devices exist which attempt to alleviate exercise-related problems as noted above. The device of Wilkinson (U.S. Pat. No. 5,354,247) shows a modular step exercise module that includes a plurality of individual steps. Wilkinson teaches a design having platforms stackable upon one another during use and stackable within one another during storage. These platforms are of varying lengths so as to provide a multi-level step arrangement. However, the width of each of these platforms remains substantially identical so that any user of the Wilkinson platform can only step up at progressively increasing heights from one direction. Any change in the stepping direction by the user requires the Wilkinson device to moved, thus interrupting aerobic exercise. Another more basic adjustable stepping platform, also described by Wilkinson, (U.S. Pat. No. 5,108,089) (Wilkinson II). Wilkinson II includes an adjustable feature that is incorporated into support legs which may be adjusted so as to alter the height of the stepping platform. This stepping platform is of limited use in any exercise routine requiring multiple step elevations.

The device of Goldstein et al. (U.S. Pat. No. 5,213,554) is a stepper having adjustable feet incorporated into supports which may be adjusted so as to alter the height of the stepping platform, albeit by only providing one step-level at a time. The device of Irwin (U.S. Pat. No. 5,318,489) is a stepping platform with features similar to both Wilkinson devices. The design taught by Irwin includes stackable support sections that change the level of the main stepping platform. The resultant stepping platform is thus adjustable in height but fails to provide a user with concurrent multiple elevations. Similarly, the device of Ullman (U.S. Pat. No. 5,176,596) is a three-position stepping platform. The device of Ullman has two pieces which are adjustably arranged to provide three levels of elevation. However, at any given moment, the platform is only capable of one particular level. Accordingly, a user would have to constantly re-adjust the Ullman stepping platform as desired and could not utilize this design for exercise routines that required stepping movements of increased elevations. The device of Adamczyk et al. (U.S. Pat. No. 5,154,678) is a stepping platform which is similar to the stackable support sections of Irwin except that the entire platform of Adamczyk et al. is effectively a stackable support section. Adamczyk et al. is also adjustable but maintains only one platform level at any given moment. The device of Thomas et al. (U.S. Pat. No. 5,050,861) is an adjustable exercise step of a design that incorporates one box and one slightly smaller inverted box to form a generally rectangular enclosure. The box-like design of Thomas et al. has a platform that is adjustable to a variety of heights but only one level at a time.

The device of present inventor, described in pending application number 08/651,917 solves many of these problems but is relatively heavy and allows for uniform tiers only.

None of the prior-art devices provides a stepping platform having multiple platform levels of non-uniform heights which may be utilized from more than one direction without adjustment. Furthermore, the prior-art devices fail to provide a multi-level stepper platform that permits the user to step from one level to several others in any direction - front, back, right side, left side, diagonally. Therefore, what is needed is a stepping platform that provides individual steps of varying heights. What is also need is such a stepping platform that includes an adjustment arrangement designed to enable a user to create and re-adjust various stepping platform configurations quickly and easily. What is also needed is such a stepping platform that permits movement from one level to another in multiple directions and that is relatively lightweight and convenient to transport..

SUMMARY OF THE INVENTION

The basic stepping platform of the present invention incorporates a single center platform and one or more side platforms deployed about the center platform. These side platforms can be all the same height or they can be of up to four different heights, though all lower than the top of the center platform, thereby providing the step. The side platforms are designed to be detachably coupled to the center platform, so that the entire unit can be assembled and disassembled easily. In one embodiment of the present invention, the center platform and all side platforms are hollow shells, thus further lightening the total weight of the modular collection, thereby making it relatively convenient to transport, as from one's home to a park or other exercise site. The modules of the present invention may be made from a variety of materials including, but not limited to, plastic, rubber, wood, and metal, where standard strength-of-materials considerations dictate how much of a given material to use. The embodiment of the present invention using hollow shells stands in general contrast to prior-art designs, in none of which are the sections or their counterparts made of shells. In addition to reducing the weight that must be carried, this approach can lead to greater ease of manufacture and, consequently, reduced manufacturing costs.

Any of a variety of coupling methods may be used in a particular embodiment of the present invention. These would include, but not be limited to simple nut-and-bolt assemblies designed to pass through holes in the walls of the side modules and center module respectively. Another method would be based on hook-and-loop fasteners (such as are used with VELCRO®), with sheets of hook-and-loop mating materials affixed to one external wall of each side module and complementary sheets affixed to the four walls of the center platform. Yet another approach would be to form the modules so as to have mating grooves and projections. This latter approach can take many different particular forms, one of which is set out in the Preferred Embodiment. The goal in any event is to ensure that the side modules can be quickly attached to the center module and yet in a way that ensures overall stability for the stepper.

If the stepper is fabricated of plastic, injection-molding, cold-press, or any suitable method of manufacture common in the art may be used. Such fabrication makes it relatively easy to effect different configurations. A non-slip material is included on the top-most platform surface. Such a non-slip portion may include some type of ribbed design. The non-slip portion may also simply be a coating, such as porous rubber or a pumice-impregnated paint or any similar material, which would provide a high-friction surface. Such variations may be dependent upon the specific use and environment in which the stepper according to the present invention is used.

The simple yet innovative design shown by the Preferred Embodiment is to be understood as merely representative. It will be clear from the following detailed description and the foregoing comments that various embodiments exist within the scope of the present invention.

DESCRIPTION OF THE PREFERRED EMBODIMENT

The Preferred Embodiment of the present invention is constructed primarily of high-impact plastic materials, with the basic modules preferably formed using injection molding techniques.

Figure 1:
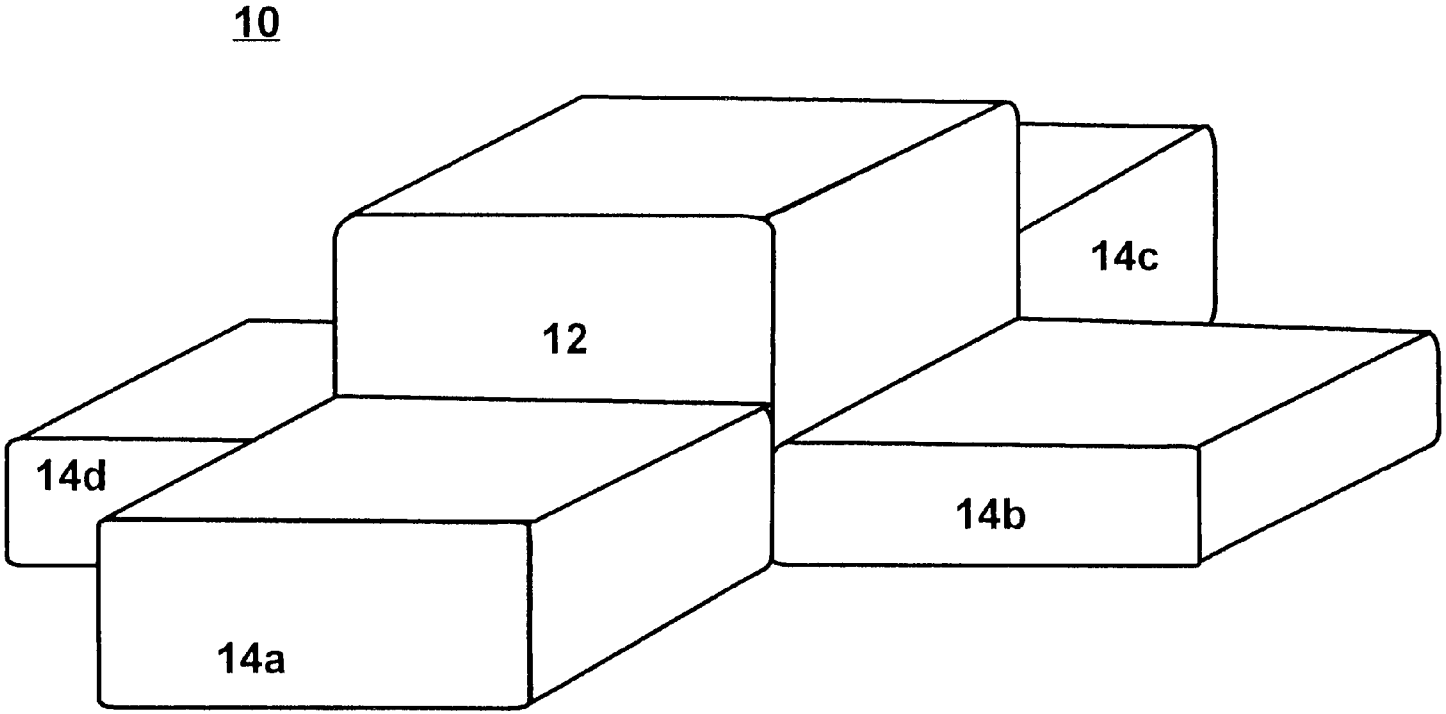
FIG. 1 is a perspective view of the stepper according to one embodiment of the present invention, where the side modules are of four different heights.
Figure 2:
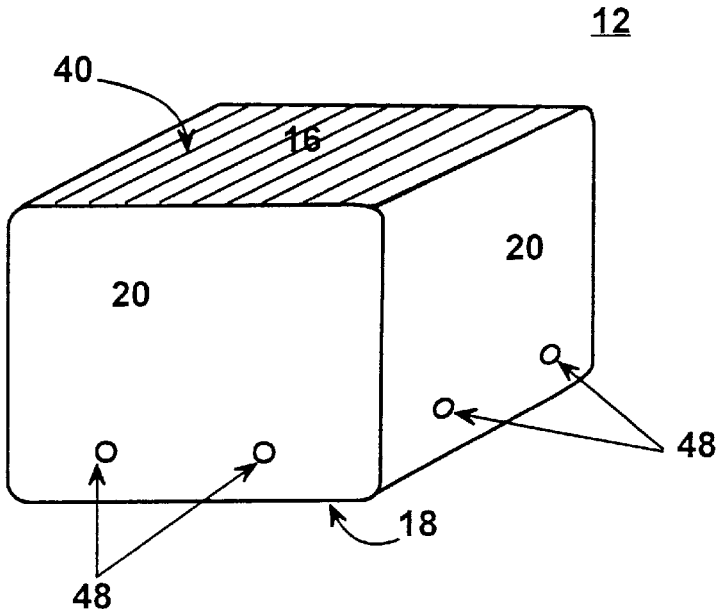
FIG. 2 is a perspective view of the upper part of the center module of the stepper according to the Preferred Embodiment of the present invention, showing the non-skid top of the platform and holes for the nut-and-screw assembly used to secure the side module(s) to the center module.
Figure 3:
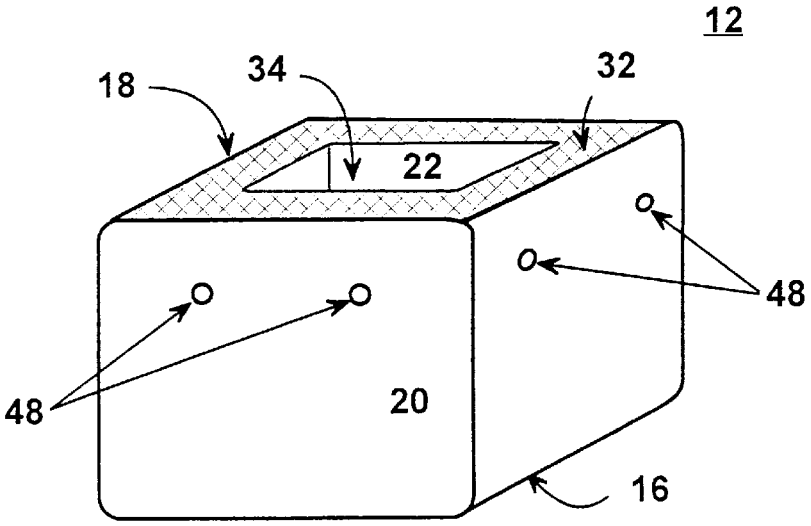
FIG. 3 is a perspective view of the lower part of the center module of the stepper according to the Preferred Embodiment of the present invention, showing the non-skid bottom of the platform and holes for the nut-and-screw assembly used to secure the side module(s) to the center module. It also show the opening in the bottom of the center module.

FIG. 1 provides an external view of the Preferred Embodiment of the modular exercise stepper 10 of the present invention, including a center module 12 and four side modules 14*a*, 14*b*, 14*c*, and 14*d* where each of the side modules 14*a*, 14*b*, 14*c*, and 14*d* has a different height. FIG. 2 and FIG. 3 show in more detail the center module 12 of the Preferred Embodiment of the present invention. In particular, FIG. 2 and FIG. 3 show a center platform 16 and a center bottom 18 connected by center walls 20. The center platform 16, center bottom 18 and center walls 20 form a hollow center core 22. Note also the holes 48 in each of the center walls 20. These are associated with the coupling mechanism for holding the center module 12 to each of the side modules 14*a*, 14*b*, 14*c*, and 14*d* and provide passage for the screws that are used for this coupling.

Figure 4:
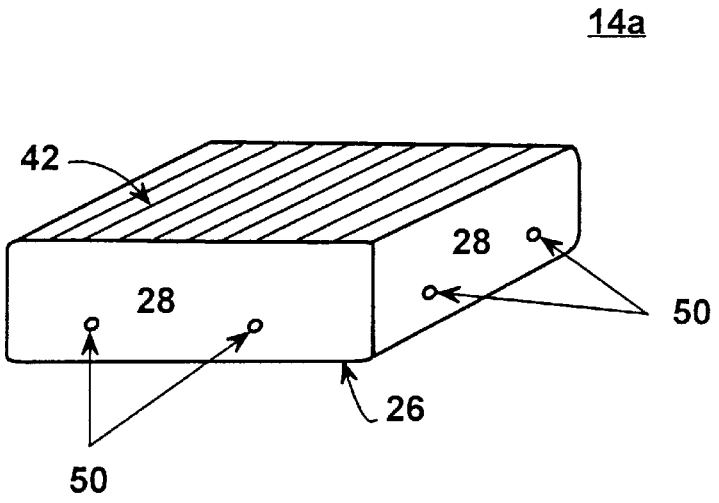
FIG. 4 is a perspective view of the upper part of a side module of the stepper according to the Preferred Embodiment of the present invention, showing the top of the platform and holes for the nut-and-screw assembly used to secure the side module(s) to the center module.
Figure 5:
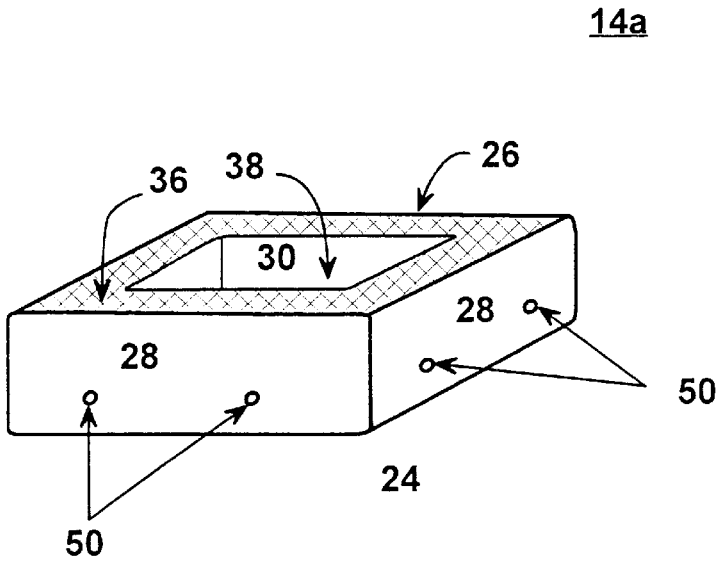
FIG. 5 is a perspective view of the lower part of a side module of the stepper according to the Preferred Embodiment of the present invention, showing the non-skid bottom and the holes for the nut-and-screw assembly used to secure the side module(s) to the center module. It also show the opening in the bottom of the side module.

Similarly, FIG. 4 and FIG. 5 show details of side module 14*a*, one of the four side modules 14*a*, 14*b*, 14*c*, and 14*d*. In the Preferred Embodiment, all of the four side modules 14*a*, 14*b*, 14*c*, and 14*d* are the same except in their height. With reference to FIG. 4 and FIG. 5 it can be seen that each of the four side modules 14*a*, 14*b*, 14*c*, and 14*d* has a side platform 24 and a side bottom 26 connected by side walls 28 that together form a hollow core 30.

Figure 6:
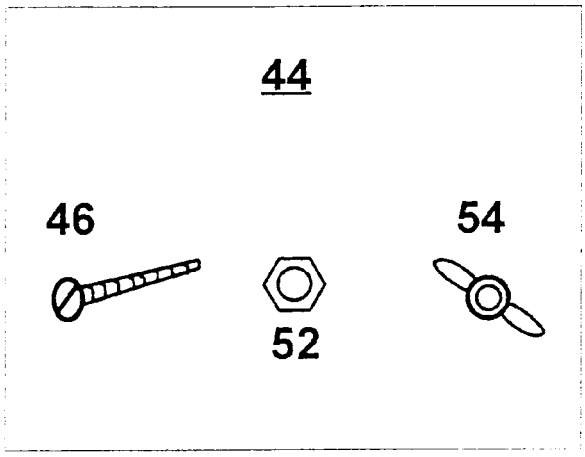
FIG. 6 is a stylized depiction of the nut-and-screw coupling means of the Preferred Embodiment of the present invention.
Figure 6:
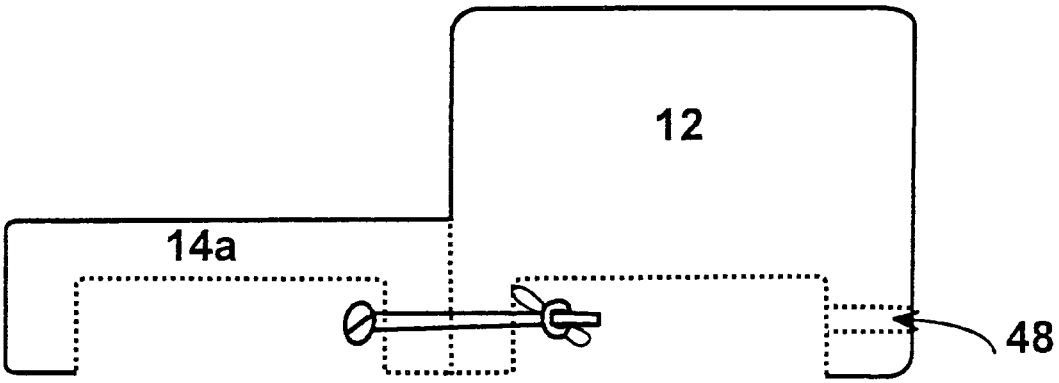

In the Preferred Embodiment, a securing assembly 44 couples the side modules 14 vertical walls 28 with the center module 12 vertical walls 20, all as shown in a stylized fashion in FIG. 6. A screw 46 passing through one of the holes 50 in a side wall 28 of the side module 14 and also through one of the holes 48 in a center wall 20 of the center module 12, and then secured by a standard hexagonal nut 52 is one such assembly 44. A wing-nut 54 may be used instead of the hexagonal nut 52 to facilitate rapid interchange of the side modules 14.

The side walls 28 are shorter than the center walls 20 such that the height of the center module 12 is greater than the heights of the side modules 14*a*, 14*b*, 14*c*, and 14*d*. In the Preferred Embodiment the side walls 28 are different heights for the different side modules 14*a*, 14*b*, 14*c*, and 14*d*, either to increase the difficulty of the workout or to provide a range of step heights from which the person exercising can choose the arrangement best suited for her or him on a particular day and in this manner vary the "impact" of the aerobic exercise being engaged in.

Referring again to FIG. 2 and FIG. 3 it is seen that the center bottom 18 of the center module 12 has a lower surface 32 consisting of non-slip material so as to keep the stepper 10 from sliding during use. Note also the center opening 34 provided to allow access to the hollow center core 22. The center platform 16 of the center module 12 also has an upper surface 40 covered with non-slip material for the user's traction.

Similarly, and as shown in FIG. 4 and FIG. 5, the side bottom 26 of each of the side modules 14*a*, 14*b*, 14*c*, and 14*d* also has a lower surface 36 covered with non-slip material to keep the stepper 10 from sliding during use and that each side module also has a side opening 38 to allow access to the hollow side core 30. The side platform 24 of each of the side modules 14*a*, 14*b*, 14*c*, and 14*d* has an upper surface 42 covered with non-slip material for the user's traction.

Figure 7:
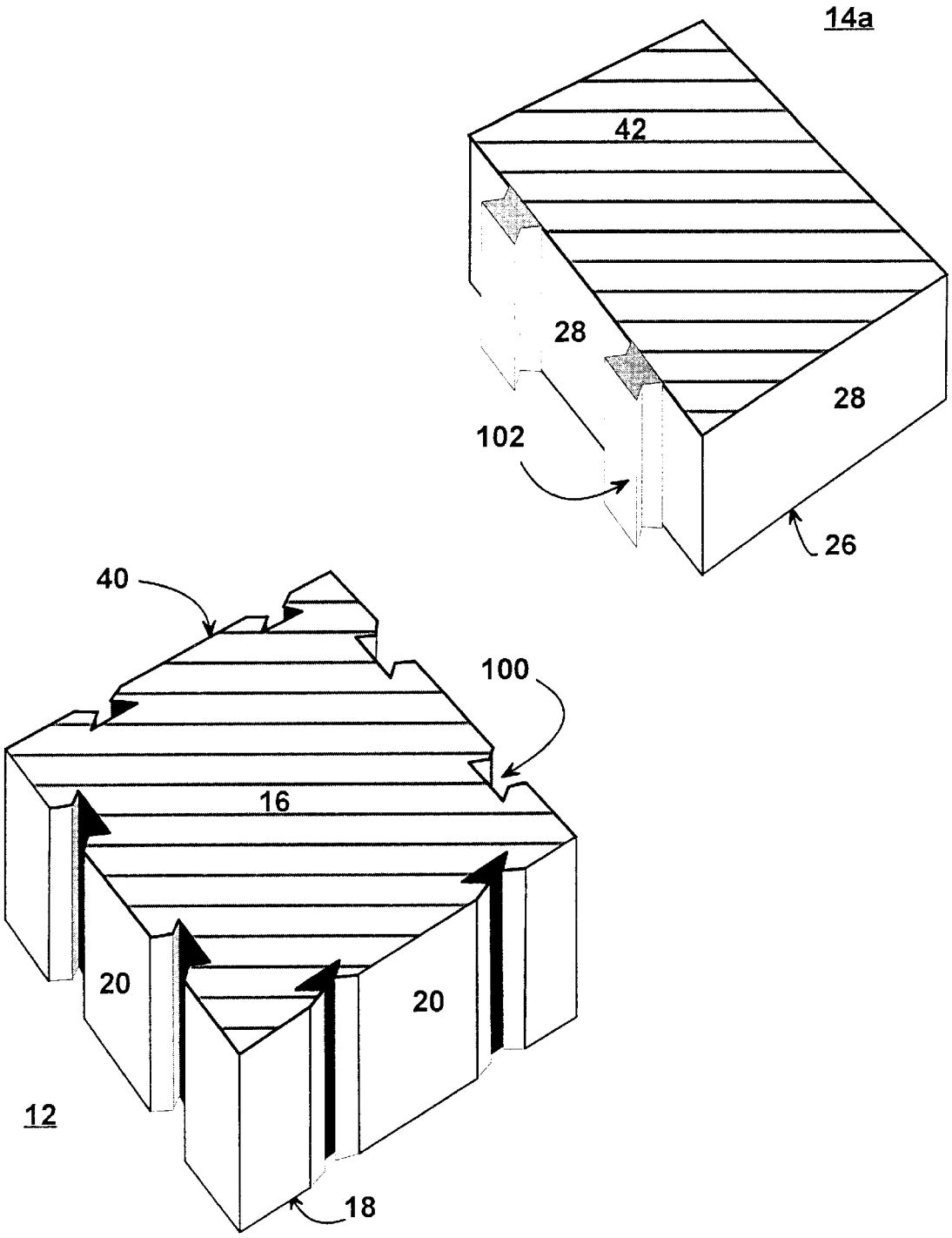
FIG. 7 shows an alternative coupling means based on a particular groove-and-protuberance set to allow coupling between side modules and center module.

FIG. 7 shows an alternative method of securing the center module 12 to one or more of the side modules 14*a*, 14*b*, 14*c*, and 14*d*. In this approach, the center module 12 and the side modules 14*a*, 14*b*, 14*c*, and 14*d* are provided with mating groove-and-protuberance assemblies. This would generally be done during the manufacture of the modules, in such a way that a groove 100 a center wall 20 would be of a size and shape to accept slidingly a protuberance 102 a side wall 28.

Figure 8:
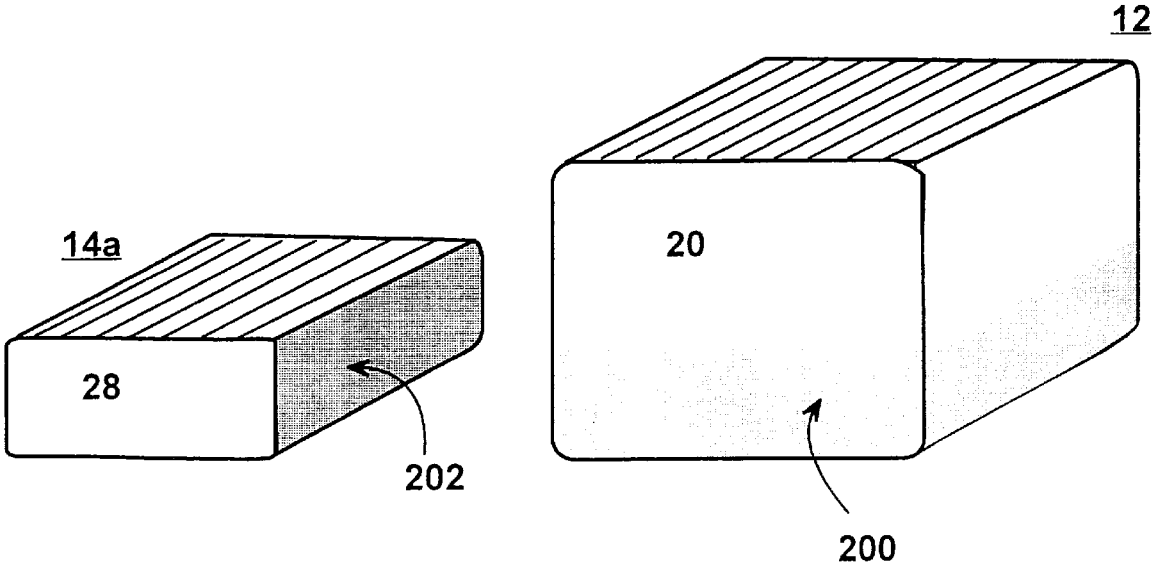
FIG. 8 shows a stylized version of another coupling alternative to be used with the present invention, that using hook-and-loop materials to detachably hold the side module (s) to the center module.

FIG. 8 illustrates yet another means of detachably coupling the side module(s) to the center module. On a side wall 28 a side hook-and-loop pad 202 is permanently affixed and on a center wall 20 a center hook-and-loop pad 200 is affixed, where the side hook-and-loop pad 202 is complementary to the center hook-and-loop pad 200.

It must be recognized that alternative materials and manufacture methods may be used as appropriate without straying from the scope of the instant invention. Though the Preferred Embodiment utlizes high-impact plastic which may be injection-molded into an assortment of shapes and sizes, a variety of other suitable materials may used. Accordingly, while the modular stepper has been described in connection with a particular embodiment, the true scope of the invention should not be so limited since other modifications will become apparent to one skilled in the art in light of the specification and following claims.

I claim:

1. A modular stepper, comprising:

a center module having a center top, a center bottom, and center walls connecting said center top and said center bottom, wherein said center walls have a center height and wherein an upper surface of said center top and a lower surface of said center bottom are covered with a non-slip material;

four side modules, each of said side modules having a side top, a side bottom, and side walls connecting said side top and said side bottom, wherein said walls have a side height and wherein each of said side modules has a different height, wherein an upper surface of said side top and a lower surface of said side bottom are covered with a non-slip material, and wherein each of said side modules can be detachably coupled to said center module such that said side modules form a horizontal array surrounding said center module; and a means for detachably coupling each of said four side modules to said center module with one of said center walls forming an interface with one of said side walls, wherein each of said side modules can be detachably coupled to any of said center walls of said center module.

2. The modular stepper of claim 1 wherein said means of detachably coupling comprises a number of nut-and-bolt assemblies, a set of side holes in said side walls, and a set of center holes in said center walls such that said set of side holes can be aligned with said set of center holes and wherein one of said number of nut-and-bolt assemblies can be inserted and affixed at each of said side holes when said side modules are deployed about said center module.

3. The modular stepper of claim 1 wherein said means of detachably coupling comprises a number of grooves located in said center walls and a number of matching protuberances in said side walls such that each of said side modules can be tightly though detachably attached to said center module by sliding one or more of said protuberances into an equal number of said grooves.

4. The modular stepper of claim 1 wherein said means of detachably coupling comprises a single horizontal groove along a bottom of each of said center walls such that a portion of a bottom of one of said side walls of each of said side modules can be inserted into said horizontal groove, thus tightly but detachably affixing each of said side modules to said center module.

* * * * *